US006858984B2

(12) United States Patent
Yamashita

(10) Patent No.: US 6,858,984 B2
(45) Date of Patent: Feb. 22, 2005

(54) VACUUM CONTAINER AND DISPLAY DEVICE HAVING A GETTER WITH A GETTER MATERIAL

(75) Inventor: Motohiro Yamashita, Ehime-ken (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 193 days.

(21) Appl. No.: 09/910,784

(22) Filed: Jul. 24, 2001

(65) Prior Publication Data

US 2002/0033667 A1 Mar. 21, 2002

(30) Foreign Application Priority Data

Jul. 28, 2000 (JP) ..... 2000-228830

(51) Int. Cl.[7] ..... H01J 17/24
(52) U.S. Cl. ..... 313/553; 417/48
(58) Field of Search ..... 313/553–556, 313/559–561, 557; 417/48–51

(56) References Cited

U.S. PATENT DOCUMENTS

| | | | | |
|---|---|---|---|---|
| 4,486,686 A | | 12/1984 | Della Porta | |
| 5,508,586 A | * | 4/1996 | Martelli et al. | 313/560 |
| 5,635,795 A | | 6/1997 | Itoh et al. | |
| 5,789,858 A | | 8/1998 | Itoh et al. | |
| 5,789,859 A | | 8/1998 | Watkins et al. | |

FOREIGN PATENT DOCUMENTS

| | | |
|---|---|---|
| GB | 1481944 | 8/1977 |
| JP | 514958 | 1/1976 |
| JP | 51112175 | 10/1976 |
| JP | 59170366 | 11/1984 |
| JP | 3285232 | 12/1991 |
| JP | 4289640 | 10/1992 |
| JP | 877951 | 3/1996 |
| JP | 9106770 | 4/1997 |
| JP | 9199009 | 7/1997 |
| JP | 1167127 | 3/1999 |
| JP | 2894259 | 3/1999 |
| JP | 2000-195447 | 7/2000 |
| KR | 10202400 | 3/1999 |

OTHER PUBLICATIONS

English Language Abstract of JP Appln. No. 51–112175.
Partial English Language Translation of JP Appln. No. 59–170366.
English Language Abstract of JP Appln. No. 8–77951.
English Language Abstract of JP Appln. No. 3–285232.
English Language Abstract of JP Appln. No. 9–106770.
Partial English Language Translation of JP Appln. No. 51–4958.
English Language Abstract of JP Appln. No. 4–289640.
English Language Abstract of JP Appln. No. 9–199009.
English Language Abstract of JP Appln. No. 11–67127.
Partial English Language Translation of Korean Appln. No. 10–202400.
English Language Abstract of JP 2894259.

* cited by examiner

*Primary Examiner*—Joseph Williams
(74) *Attorney, Agent, or Firm*—Greenblum & Bernstein, P.L.C.

(57) ABSTRACT

A vacuum container includes a getter filled with a gettering material for maintaining a vacuum condition, and includes a getter support which includes a control plate member, a support leg and a holder. The getter support is arranged in the spreading direction of the getter material in order to limit the directions of the spreading of the getter material. This structure reduces the number of relevant components, simplifies the procedure of fabrication and maintains the degree of vacuum.

23 Claims, 8 Drawing Sheets

VACUUM CONTAINER AND DISPLAY DEVICE HAVING A GETTER WITH A GETTER MATERIAL

BACKGROUND OF THE INVENTION

1. Field of the Invention

The present invention relates to a vacuum container or vacuum envelope and a display device where a vacuum state is maintained by spreading getter materials in a vacuum casing such as a vacuum envelope or enclosure. Characteristic examples of such a display device are a vacuum-type video display with electron emitter elements such as a field emission display (referred to as "FED" hereinafter), a vacuum fluorescent display (VFD), and a field emission (FE) sensor.

2. Description of the Prior Art

As liquid crystal displays have commonly been used as flat-panel displays, they may be replaced by FEDs.

FIG. 11 is a cross sectional view of a conventional FED with electron emitter elements. The FED has a vacuum envelope 18 composed of an electron emission substrate 25 and a light emitter substrate 26 where the two substrates 25 and 26 are air-tightly joined to each other by a spacer 3. The electron emission substrate 25 is provided thereon with a pattern of wiring layer 12, electron emitter elements 13, a pattern of insulating layer 14, and lead electrodes 15, and the light emitter substrate 26 is provided thereon with an opposite pattern of anode layers 16 and a pattern of fluorescent layers 17. A getter chamber 20 of a box-like shape is provided on the back side of the electron emitter substrate 25 of the vacuum envelope 18. The getter chamber 20 is communicated via an exhaust aperture 23 with the interior of the vacuum envelope 18 and the getter chamber 20 includes a getter 4 held under pressure by a spring 21.

The getter 4, as shown in FIG. 12, comprises a getter material 6 filled in an annular, nickel plated metallic frame 5 for gettering action. The getter material 6 may be a powder alloy of, for example, $BaAl_4$. In process, the air in the vacuum envelope 18 and the getter chamber 20 is discharged out through from the exhaust aperture 24 of the getter chamber 20 and an exhaust tube 22. Then, when the exhaust tube 22 has been sealed, the vacuum envelope 18 and the getter chamber 20 are turned to and maintained in a vacuum state. As the getter 4 is heated by means of such as a high-frequency induction heating method (not shown), the getter material 6 is vapor deposited on an inner surface portion of the getter chamber 20 to form a getter film 19. The vacuum state in the vacuum envelope 18 and the getter chamber 20 is maintained in a higher degree of vacuum, so that the emission of electrons from the electron emitter elements 13 can stably be carried out.

It is essential for the display device having the above described arrangement to maintain the vacuum state to such a higher degree of vacuum in the vacuum envelope that electrons can steadily be emitted at high efficiency and lower currents. For increasing the vacuum state to a high degree of vacuum, the effect of the getter absorbing gases is utilized. However, since the getter is directly supported by the spring 21 in the vacuum envelope, the getter material can hardly be controlled for spreading while being heated and vaporized by high-frequency heating. As a result, undesired conductive regions will be developed in the vacuum envelope. For eliminating the drawback, the getter chamber is located beneath the vacuum envelope but such a location thus may interrupt the flat-panel configuration of the display device.

Note here that the undesired conductive regions are developed by portions of the getter material spread and deposited on a display area thus to establish undesired connection between the electrodes which are not to be electrically connected.

SUMMARY OF THE INVENTION

The present invention is developed for solving the foregoing drawback and its object is to provide a vacuum container such as a vacuum envelope and a display device where a getter is arranged in the vacuum envelope so as to reduce the number of relevant components, simplify the process of fabrication, inhibit declination in the degree of vacuum, and suppress the spreading of getter flushes in directions.

For solving the foregoing drawback, there is provided a vacuum container according to claim 1 of the present invention which has a getter with a getter material provided therein for maintaining the degree of vacuum, comprising: a getter support consisting mainly of a control plate member, a support leg, and a holder and arranged at the spreading direction of the getter material for controlling the spreading of the getter material in desired directions.

The vacuum container according to claim 1 of the present invention can control the spreading of the getter material in directions. This allows the getter to be disposed within the vacuum container. Also, as a getter chamber required in the prior art is eliminated, the vacuum container can be shaped flat.

The vacuum container according to claim 1 of the present invention may be modified, as defined in claim 2, wherein while the control plate member has a hollow space, the holder holds the getter with its spreading side located at an opening of the hollow space of the control plate member and the control plate member is fixedly anchored by the support leg in the vacuum container.

The vacuum container according to claim 2 of the present invention permits at least a primary portion of the spreading of the getter material of the getter to be controlled by the getter support during the evaporation of the getter material and also a secondary portion of the spreading to be deposited on the inner wall of the vacuum container.

The vacuum container according to claim 2 of the present invention may be modified, as defined in claim 3, wherein while the getter material released from the getter is reflected on the control plate member and flied out from the control plate member, the control plate member is arranged for permitting the getter material to reflect at least two times on the control plate member.

The vacuum container according to claim 3 of the present invention permits at least the secondary portion of the spreading of the getter material of the getter to be controlled by the getter support during the evaporation of the getter material and also a tertiary portion of the spreading, if any, to be deposited on the inner wall of the vacuum container.

The vacuum container according to claim 1 of the present invention may be modified, as defined in claim 4, wherein when the control plate member is a combination of a conical shape and a cylindrical shape with the hollow space so that its longitudinal cross section includes the vertex and the center of the base of the conical shape, assuming that the bottom of the cylindrical shape is a and the side of the cylindrical shape is b, the angle at the vertex of the control plate member is equal to or smaller than two times a reverse tangent $\tan^{-1}(b/a)$ of the angle defined by the two sides a and b and the spreading side of the getter is held by the holder to stay within an isosceles triangle of which the base is equivalent to the base of the cylindrical shape and the angle at each end of the base is expressed by $\tan^{-1}(b/a)$ The vacuum container according to claim 4 of the present invention permits at least a secondary portion of the spreading of the getter material of the getter to be controlled by the getter support during the evaporation of the getter material and also a tertiary portion of the spreading, if any, to be deposited on the inner wall of the vacuum container.

The vacuum container according to claim 2 of the present invention may be modified, as defined in claim 5, wherein the control plate member has an opening of the hollow space arranged to have a polygonal or arcuate shape in the cross section.

The vacuum container according to claim 5 of the present invention can fabricate the control plate member with ease and enhance the effect of getter pumping thus maintaining a higher level of vacuum.

The vacuum container according to claim 2 of the present invention may be modified, as defined in claim 6, wherein the getter support is made of at least a metallic material.

The vacuum container according to claim 6 of the present invention can endure the effect of high-frequency heating during the gettering.

The vacuum container according to claim 1 of the present invention may be modified, as defined in claim 7, wherein two or more of the getter supports are provided.

The vacuum container according to claim 7 of the present invention can maintain a higher level of vacuum therein and may be increased in the dimensions.

The vacuum container according to claim 1 of the present invention may be modified, as defined in claim 8, wherein the support leg holds two or more of the control plate member.

The vacuum container according to claim 8 of the present invention can reduce the number of relevant components.

There is provided a display device according to claim 9 of the present invention which has a getter with a getter material provided therein for maintaining the degree of vacuum, comprising: a getter support including a control plate member, a support leg, and a holder and the getter support is arranged at the spreading direction of the getter material for controlling the spreading of the getter material in desired directions.

The display device according to claim 9 of the present invention permits the spreading of the getter material to be controlled in directions. This allows the getter to be disposed in the display device. As a getter chamber required in the prior art is eliminated, the display can be shaped flat.

The display device according to claim 9 may further comprises, as defined in claim 10 of the present invention: an electron emitter substrate having at least a pattern of wiring layer, electron emitter elements, a pattern of insulating layer, and lead electrode all provided on a first glass substrate; a light emitter substrate having at least anodes and fluorescent layers all provided on a second glass substrate; and a spacer provided between the electron emitter substrate and the light emitter substrate so that the electron emitter substrate and the light emitter substrate can be spaced by a predetermined distance from each other.

The display device according to claim 10 of the present invention permits the spreading of the getter material to be controlled in directions. This allows the getter to be disposed in the display device. As a getter chamber required in the prior art is eliminated, the display can be shaped flat.

The display device according to claim 9 may be modified, as defined in claim 11 of the present invention, wherein the control plate member has a hollow space, the holder holds the getter with its spreading side located at an opening of the hollow space of the control plate member, and the control plate member is fixedly anchored by the support leg in the display device.

The display device according to claim 11 of the present invention permits at least a primary portion of the spreading of the getter material of the getter with the getter support to be controlled by the getter support during the evaporation of the getter material and also a secondary portion of the spreading to be deposited on the inner wall of the display device, hence inhibiting the display area from receiving the spreading and developing unwanted electrical conduction.

The display device according to claim 11 may be modified, as defined in claim 12 of the present invention, wherein while the getter material released from the getter is reflected on the control plate member and flied out from the control plate member, the control plate member is arranged for permitting the getter material to reflect at least two times on the control plate member.

The display device according to claim 12 of the present invention permits at least a secondary portion of the spreading of the getter material of the getter to be controlled by the getter support during the evaporation of the getter material and also a tertiary portion of the spreading, if any, to be deposited on the inner wall of the display device.

The display device according to claim 9 may be modified, as defined in claim 13 of the present invention, wherein when the controlling member is a combination of a conical shape and a cylindrical shape with the hollow space so that its longitudinal cross section includes the vertex and the center of the base of the conical shape, assuming that the bottom of the cylindrical shape is a and the side of the cylindrical shape is b, the angle at the vertex of the control plate member is equal to or smaller than two times a reverse tangent $\tan^{-1}(b/a)$ of the angle defined by the two sides a and b and the spreading side of the getter is held by the holder to stay within an isosceles triangle of which the base is equivalent to the base of the cylindrical shape and the angle at each end of the base is expressed by $\tan^{-1}(b/a)$.

The display device according to claim 13 of the present invention permits at least the secondary portion of the spreading of the getter material of the getter to be controlled by the getter support during the evaporation of the getter material and also a tertiary portion of the spreading, if any, to be deposited on the inner wall of the display device.

The display device according to claim 11 of the present invention may be modified, as defined in claim 14 of the present invention, wherein the control plate member has an opening of the hollow space arranged to have a polygonal or arcuate shape in the cross section.

The display device according to claim 14 of the present invention can fabricate the control plate member with ease thus to favorably provide the effect of getter pumping and maintain a higher level of vacuum.

The display device according to claim 11 may be modified, as defined in claim 15 of the present invention, wherein the getter support is provided between the electron emitter substrate and the light emitter substrate and the opening of the control plate member is at least not smaller than the size of the getter.

The display device according to claim 15 of the present invention needs not to change its thickness for providing the getter support. This allows the display device to be thinned in the size.

The display device according to claim 11 may be modified, as defined in claim 16 of the present invention, wherein the getter support is made of at least a metallic material.

The display device according to claim 16 of the present invention can endure the effect of high-frequency heating during the gettering.

The display device according to claim 9 may be modified, as defined in claim 17 of the present invention, wherein two or more of the getter supports are provided.

The display device according to claim 17 of the present invention can maintain a higher level of vacuum and be increased in the size.

The display device according to claim 9 may be modified, as defined in claim 18 of the present invention, wherein the support leg holds two or more of the control plate members.

The display device according to claim 18 of the present invention can reduced the number of relevant components.

The display device according to claim 9 may be modified, as defined in claim 19 of the present invention, wherein the getter support is located on the outer side of a display area of the display device.

The display device according to claim 19 of the present invention can maintain the vacuum state to a uniform level, thus inhibiting uniformity errors in the display.

The display device according to claim 9 may be modified, as defined in claim 20 of the present invention, wherein the getter supports are provided opposite to each other so as to sandwich the display area therebetween.

The display device according to claim 20 of the present invention can maintain the vacuum state to a uniform level, thus inhibiting uniformity errors in the display.

The display device according to claim 10 may be modified, as defined in claim 21 of the present invention, wherein the side of the getter where the getter material is exposed faces the electron emitter elements and the getter support is provided between the getter and the electron emitter elements so that spreading particles of the getter material are collided at least once with the control plate member or reflected at least once on the control plate member.

The display device according to claim 21 of the present invention permits at least a primary portion of the spreading of the getter material of the getter to be controlled by the getter support during the evaporation of the getter material and also a secondary portion of the spreading to be deposited on the inner wall of the display device, hence inhibiting the display area from receiving the spreading and developing unwanted electrical conduction.

DETAILED DESCRIPTION OF THE INVENTION (Embodiment 1)

Embodiment 1 of the present invention will be described referring to FIGS. 1, 2, 3, and 12.

Figure 1:
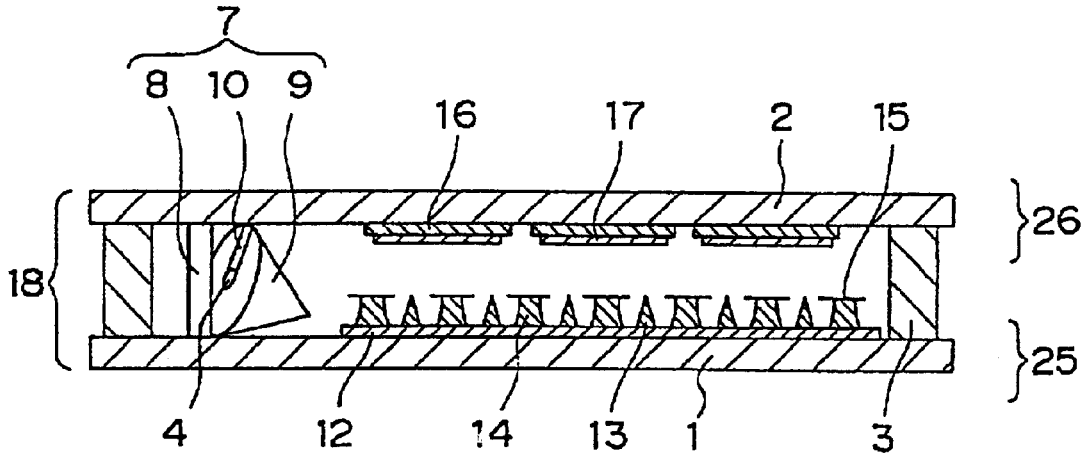
FIG. 1 is a cross sectional view of a display device according to Embodiment 1 of the present invention.
Figure 2A:
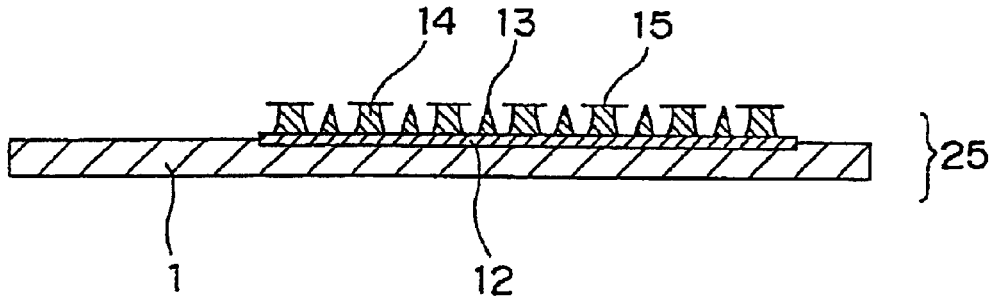
FIGS. 2A and 2B are cross sectional views of an electron emitter substrate.
Figure 2B:
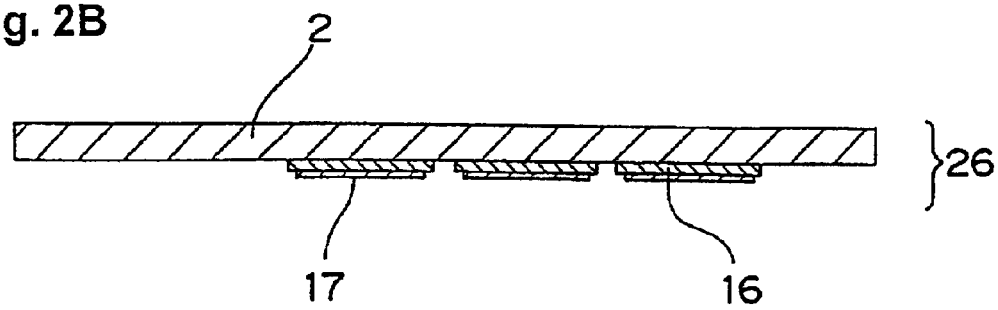
Figure 3A:
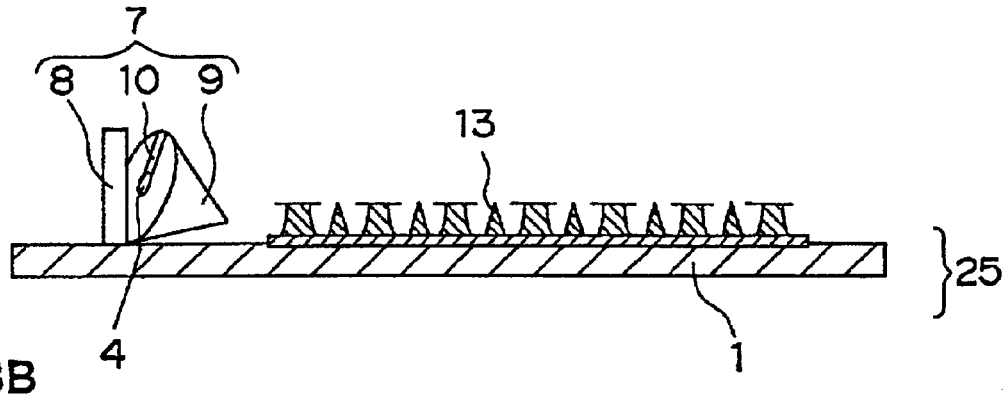
FIGS. 3A and 3B are cross sectional views of the display device according to Embodiment 1 of the present invention.
Figure 3B:
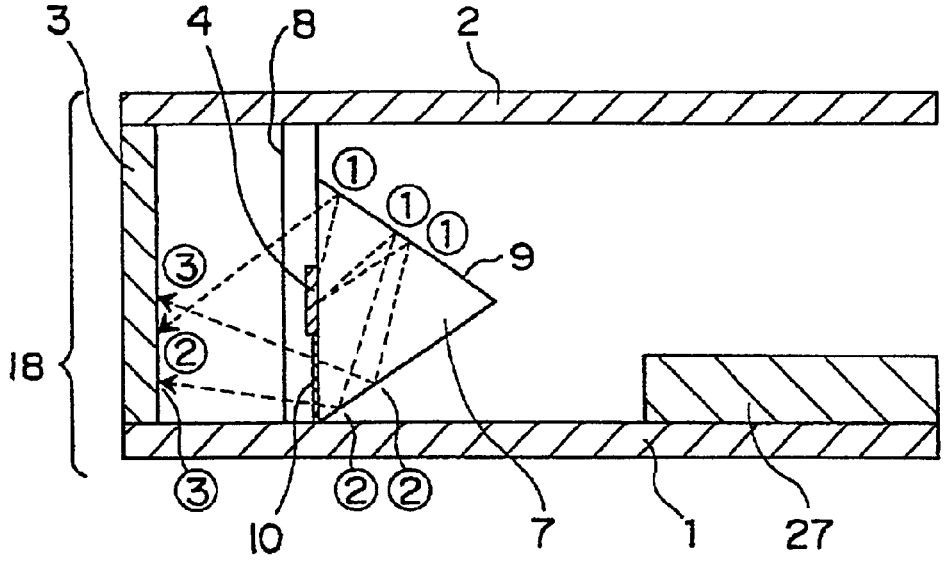

FIG. 1 is a cross sectional view of a display device according to Embodiment 1 of the present invention, FIGS. 2A and 2B are cross sectional views of an electron emitter substrate and light emitter substrate 26, respectively, and FIGS. 3A and 3B show the display device including a getter support according to Embodiment 1 of the present invention.

In FIGS. 1 and 3A, the getter support 7 is illustrated in a perspective manner, not a cross sectional manner, for clarifying its interior. The cross section of the getter support 7 is shown in FIG. 3B.

As shown in FIGS. 1, 2, and 3, the display device comprises a spacer 3, a getter 4, the getter support 7, electron emitter substrate 25, and light emitter substrate 26. The electron emitter substrate 25 has a first glass substrate 1 arranged on which a pattern of wiring layer 12, electron emitter elements 13, a pattern of insulating layers 14, and lead electrodes 15 are provided in a sequence. The light emitter substrate 26 has a second glass substrate 2 on which transparent anodes 16 made of e.g. ITO (indium tin oxide) and a pattern of fluorescent layer 17 made mainly of e.g. ZnO: Zn materials are sequentially formed. The spacer 3 is arranged of a rectangular frame and assembled together and located between the electron emitter substrate 25 and the light emitter substrate 26 opposite to each other, thus forming a vacuum envelope 18. The getter support 7 comprises a support leg 8, a control plate member 9, and a holder 10. The getter support 7 is provided for controlling the direction of spreading of the getter material 6.

Figure 12:
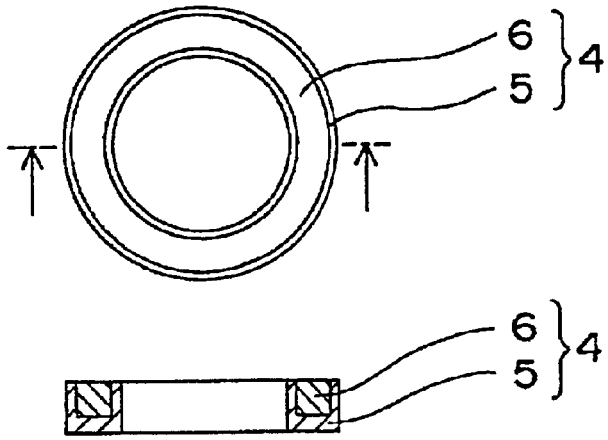
PRIOR ART Fig. 12
FIG. 12 illustrates a plan view and a cross sectional view of a evaporation-type getter.

As described with reference to FIG. 12, the getter 4 has a structure in which a getter material 6 is filled in a nickel plated, annular metallic frame 5 for gettering action. The getter 4 has two sides, one for a getter spreading side where the getter material 6 is exposed and the other of a back side where the getter material 6 is not exposed. The getter material 6 may be a powder alloy of, for example, $BaAl_4$. After air in the vacuum envelope 18 has been discharged from an exhaust aperture (not shown) provided in the vacuum envelope 18, the vacuum envelope 18 is sealed off with its exhaust aperture closed and thus remains in a vacuum state. Then, the getter material 6 is heated and vaporized by means of high-frequency induction heating (not shown). This causes the getter material 6 to be deposited as a getter layer on the inner wall of the vacuum envelope 18. Accordingly, as the vacuum state in the vacuum envelope 18 is enhanced, electrons can be emitted in stable from the electron emitter elements 13 in the display device.

FIG. 2A is a cross sectional view of the electron emitter substrate 25. For example, the wiring layer 12 of a highly conductive material such as Au is patterned on the first glass substrate 1 made of a uniform thickness of 1 to 2 mm, of a light transmissive soda lime glass material and the lead electrodes 15 made of Cr are provided on an insulating layer 14 formed on the wiring layer 12. The soda lime glass material has a softening point of substantially 700° C. The electron emitter elements 13 are made of, for example, molybdenum (Mo), which acts as cool cathodes each having a conical shape called spindle type and having a uniform height in a degree of 1 micrometer. These may generally be deposited by a thin film forming manner such as sputtering. The lead electrode 15 is partially removed by, e.g., ion etching, to provide substantially oval apertures 15*a* of 1 to 2 $\mu$m in diameter through which the electron emitter elements 13 are exposed. The insulating layer 14 made of silicon dioxide ($SiO_2$) is deposited generally over the upper surface of the wiring layer 12 except for the portions of forming the electron emitter elements 13. The lead electrodes 15 are thus located on the insulating layers 14. The wiring layer 12 and the lead electrodes 15 are electrically insulated from each other by the insulating layer 14.

FIG. 2B is a cross sectional view of the light emitter substrate 26. This substrate 26 like the electron emitter substrate 25 has a second glass substrate having a uniform thickness of 1 to 2 mm, made of a light transmissive soda lime glass material and arranged over which the transparent anodes 16 are provided. The fluorescent layers 17 are deposited on the surface of the anodes 16. The soda lime glass material has a softening point of substantially 700° C. The anode 16 is made of ITO (indium tin oxide). The anode 16 is deposited to a thickness of 1 $\mu$m by a thin film forming manner such as sputtering and has a sheet resistance of not higher than 10 Ω/□ thus being high in the conductivity. The pattern of fluorescent layers 17 comprises of pixel segments, each pixel segment including three primary colors R (red), G (green), and B (blue). The fluorescent layer 17 is made of a material such as ZnO:Zn or ZnS:Ag which can emit visible light upon excited by electrons and may be deposited to a thickness of 5 $\mu$m by a manner such as thick-film screen printing.

As explained briefly, the electron emitter element 13 includes an emitter and a gate arranged wherein when the gate develops an electric field, the emitter impinges electrons towards the fluorescent layer 17 of the anode 16 which acts as a collector.

FIG. 3A shows a cross sectional view of the electron emitter substrate 25 having the getter support 7 provided thereon. The getter 4 is supported by the getter support 7 at a predetermined location on the electron emitter substrate 25 fabricated as shown in FIG. 2A.

The getter support 7 includes the control plate member 9 of a conical shape of which the diameter of the bottom is at least greater than the outer diameter of the getter 4. The getter 4 is mounted to the holder 10 so that the getter material 6 is deposited on the inner side of the control plate member 9. The support leg 8 is located for holding the control plate member 9 in the vacuum envelope 18. The control plate member 9 is not limited to the conical shape and may have a pyramid shape with a polygonal base such as a triangular pyramid.

FIG. 3B is a cross sectional view of a portion of an FED using the getter support 7. As apparent from FIG. 3B, the display device comprises the first glass substrate 1, second glass substrate 2, spacer 3, getter 4, getter support 7, and a display area 27. The display area 27 includes the wiring layer 12, electron emitter elements 13, insulating layers 14 and lead electrodes 15 as shown in FIG. 2A. in the case where the getter support 7 is used in the FED, when the getter material 6 is evaporated to be spread, at least a primary portion of the spread getter material 6 can be controlled by the getter support 7. A secondary portion of the spread getter material can also be directed and deposited on the inner wall of the vacuum envelope 18 including the spacer 3. The evaporated getter material 6 can be prevented from spreading to the display area 27, which thus remains free from undesired electrical conduction. It is assumed that an n-th dimension (n>0) of the spreading of the getter material 6 means the getter particles after reflected (n−1) times on the control plate member 9 or the inner wall of the vacuum envelope 18.

It is also desired that the spreading side of the getter 4 where the getter material 6 is exposed faces towards the display area 27 while the line between the center of the getter 4 and the vertex of the conical shape of the control plate member 9 in the getter support 7 extends across the display area 27. The positional relationship between the getter 4 and the getter support 7 permits the display area 27 to remain free from undesired electrical conduction.

As described above, the vacuum envelope 18 of this embodiment can be used as a vacuum container or namely a housing of a display device. Also, the display device may be an image display device for displaying images.

(Embodiment 2)

Embodiment 2 of the present invention will be described referring to the relevant drawings. A getter support having a control plate member which is different from that of Embodiment 1 is explained referring to FIGS. 4, 5, and 6.

Figure 4A:
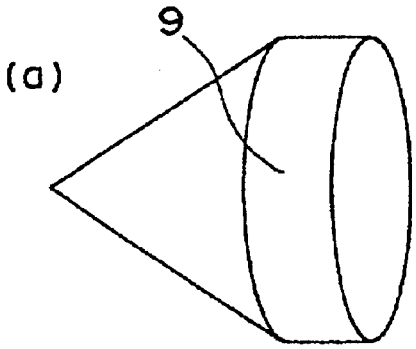
FIGS. 4A and 4B are schematic views of a control plate member in Embodiment 2 of the present invention.
Figure 4B:
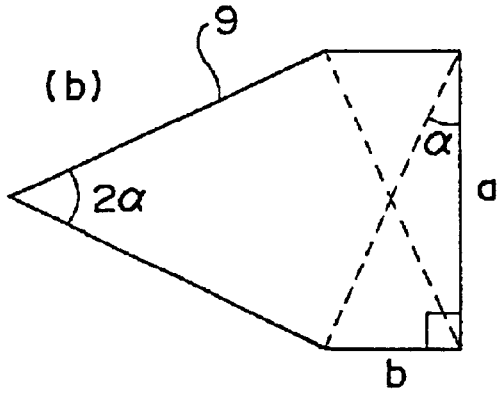
Figure 5:
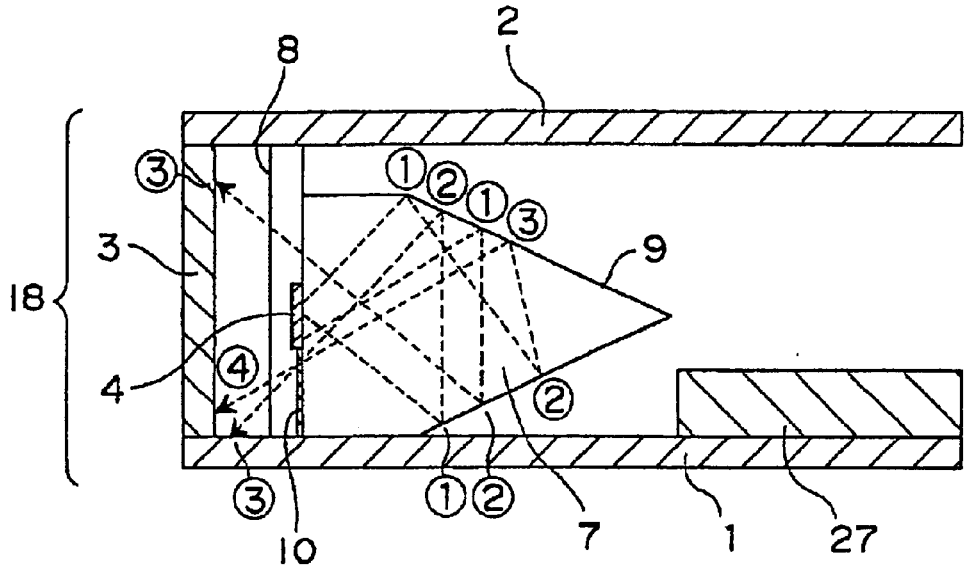
FIG. 5 is a cross sectional view of a display device according to Embodiment 2 of the present invention.
Figure 6A:
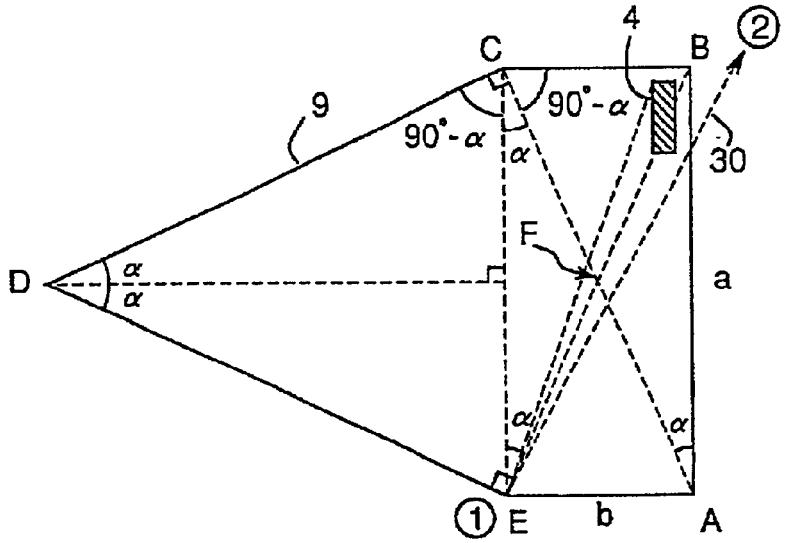
FIGS. 6A, 6B and 6C are longitudinally cross sectional views of the controlling member showing the vertex and the center of a base of a conical shape.
Figure 6B:
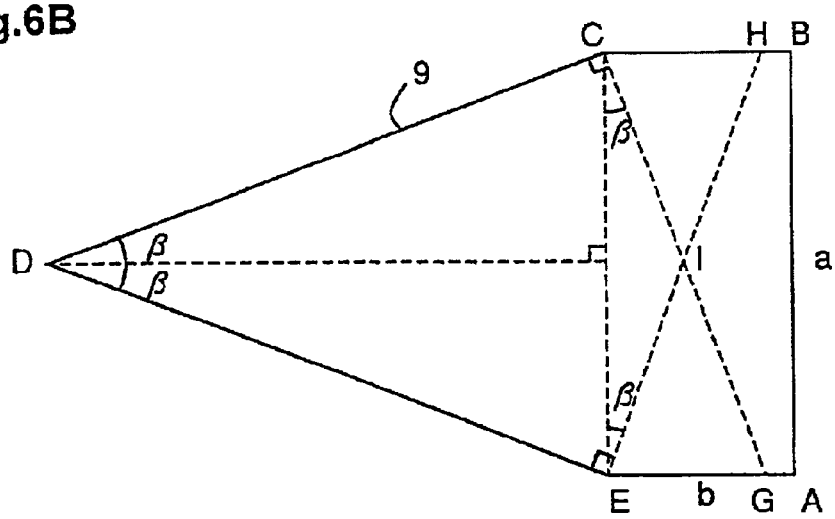
Figure 6C:
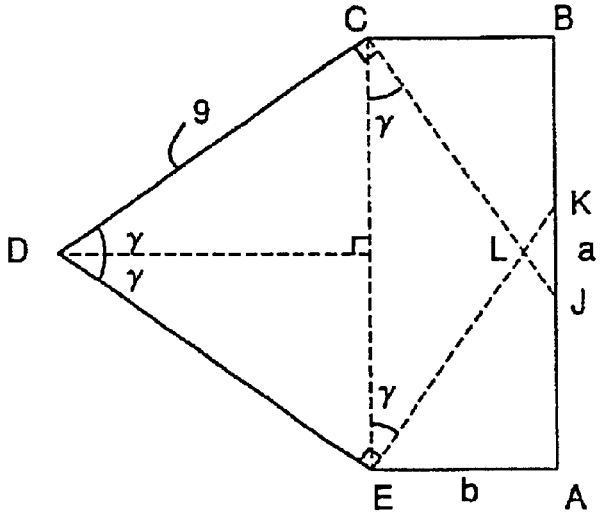

FIGS. 4A and 4B show a schematic construction of the control plate member in Embodiment 2 of the present invention, FIG. 5 is a cross sectional view of the display device of Embodiment 2, and FIGS. 6A, 6B and 6C show a construction of the control plate member 9 illustrating the vertex of its conical shape and the center of its base.

FIG. 4A is a perspective view of the control plate member 9. As shown, the control plate member 9 comprises a conical portion and a cylindrical portion having a hollow space 9*a*. FIG. 4B is a cross sectional view of the control plate member 9 showing the vertex of the conical region and the center of base region. As shown, the cylindrical portion has a diameter "a" and a height "b". The angle at the vertex of the control plate member 9 is two times greater than a reverse tangent, $\tan^{-1}(b/a)$, of the angle defined by the side "a" and the side "b". The getter 4 is hence held by the holder 10 so that its spreading side stays in an isosceles triangle of which the base is equivalent to the base "a" of the conical shape and the angle at each end of the base is expressed by $\tan^{-1}(b/a)$. The angle $\alpha$ shown in FIG. 4B is equivalent to $\tan^{-1}(b/a)$.

FIG. 5 is a cross sectional view showing a part of an FED which employs the getter support 7 including the control plate member 9 shown in FIGS. 4A and 4B. As shown in FIG. 5, the FED comprises a first glass substrate 1, a second glass substrate 2, a spacer 3, a getter 4, a getter support 7, and a display area 27. The display area 27 includes a pattern of wiring layer 12, electron emitter elements 13, a pattern of insulating layers 14 and lead electrodes 15 such as shown in FIG. 2A. In the present embodiment, as shown in FIG. 5, when the getter material 6 is evaporated, the getter support 7 enables the primary and secondary portions of the spreading of the getter material 6 from the getter 4 to at least reflect or collide against the control plate member 9, and therefore the spreading of the getter material can be effectively controlled. Also, the getter support 7 enables to control deposition of a tertiary portion of the spreading, if any, on the inner wall of the vacuum envelope 18 including the spacer 3 and to inhibit any deposition on the display area 27, thus minimizing leak currents and avoiding unwanted electrical conduction between the electrodes. Consequently, the getter support 7 in the FED according to this embodiment can highly be effective in the function.

FIG. 6A is a longitudinally cross sectional view of a control plate member 9 where the angle of its vertex is two times greater than $\tan^{-1}(b/a)$. The control plate member 9 has a pentagonal shape ABCDE in the longitudinal cross section. The side AB is "a" while the side AE and the side BC are equal to "b". The line AC and the line BE intersect each other at a point F. The angle $\alpha$ is equivalent to $\tan^{-1}(b/a)$. The angle DCA and the angle DEB are 90 degrees.

Referring to FIG. 6A, the spreading of the getter material 6 will be explained with the getter 4 located outside the isosceles triangle ABF in the control plate member 9. In case that the getter material 6 of the getter 4 is discharged from the inner side of the line BE and collided at the point E or a location on the control plate member 9 distanced slightly from the point E towards the vertex D, its incident angle is smaller than 90 degrees or the angle BED. This allows the getter material 6 to be flied out from the control plate member 9 as denoted by a dotted line 30. In case that the getter material 6 is discharged from the inner side of the line AC and collided at the point C or a location on the control plate member 9 distanced slightly from the point C towards the vertex D, the getter material 6 can be flied out from the control plate member 9 in the same manner.

With the getter 4 located on the inner side from the isosceles triangle ABF in the controlling member 9, the secondary portion of the spreading of the getter material 6 can be deposited on the inner wall of the vacuum envelope 18 including the spacer 3. When the getter 4 is located within the isosceles triangle ABF, at least the secondary portion of the spreading of its getter material 6 is reflected or collided against the control plate member 9, and the getter support 7 can control up to the secondary portion of the spreading.

FIG. 6B is a cross sectional view of a control plate member where the angle at the vertex of its conical shape is smaller than two times the inverse tangent $\tan^{-1}(b/a)$. The longitudinal cross section of the controller member 9 is a pentagonal shape ABCDE. The length of the side AB is "a" while the length of the side AE and the side BC is "b". The angle $\beta$ is smaller than the angle $\alpha$ and smaller than $\tan^{-1}(b/a)$. It is assumed that the line extending from the point C at a right angle to the side CD intersects with the side AE at a point G. It is also assumed that the line extending from the point E at a right angle to the side DE intersects with the side BC at a point H. The line CG and the line EH intersect each other at a point I.

As explained above, with the getter 4 located on the inner side than the pentagon ABHIG in the control plate member 9, the secondary portion of the spreading of the getter material 6 can be deposited on the inner wall of the vacuum envelope 18 including the spacer 3. When the getter 4 is located within the pentagon ABHIG, at least the secondary portion of the spreading of its getter material 6 is reflected or collided against the control plate member 9, and the getter support 7 can control up to the secondary portion of the spreading.

FIG. 6C is a cross sectional view of a control plate member where the angle at the vertex of its conical shape is greater than two times the inverse tangent $\tan^{-1}(b/a)$. The longitudinal cross section of the control plate member 9 is a pentagonal shape ABCDE. The length of the side AB is "a" while the length of the side AE and the side BC is "b". The angle $\gamma$ is greater than the angle $\alpha$ and greater than $\tan^{-1}(b/a)$. It is assumed that the line extending from the point C at a right angle to the side CD intersects with the side AB at a point J. It is also assumed that the line extending from the point E at a right angle to the side DE intersects with the side AB at a point K. The line CJ and the line EK intersect each other at a point L.

As explained above, with the getter 4 located on the outer side of the triangle JKL but within the control plate member 9, the secondary portion of the spreading of the getter material 6 can be deposited on the inner wall of the vacuum envelope 18 including the spacer 3. When the getter 4 is located within the triangle JKL, at least the secondary portion of the spreading of its getter material 6 is reflected or collided against the control plate member 9, and the getter support 7 can control up to the secondary portion of the spreading.

It is understood that the longitudinal cross section defined by the vertex and the center of the base of the conical shape of the control plate member 9 includes the getter 4.

It is desired that the spreading side of the getter 4 where the getter material 6 is exposed faces towards the display area 27 and the line extending from the center of the getter 4 and the vertex of the control plate member 9 in the getter support 7 intersects with the display area 27. The positional relationship between the getter 4 and the getter support 7 can inhibit the display area 27 from unwanted electrical conduction at higher effectiveness.

The vacuum envelope 18 is not limited to the housing of a display device but may be used as a vacuum container.

Another modification of the support leg will be explained.

Figure 7:
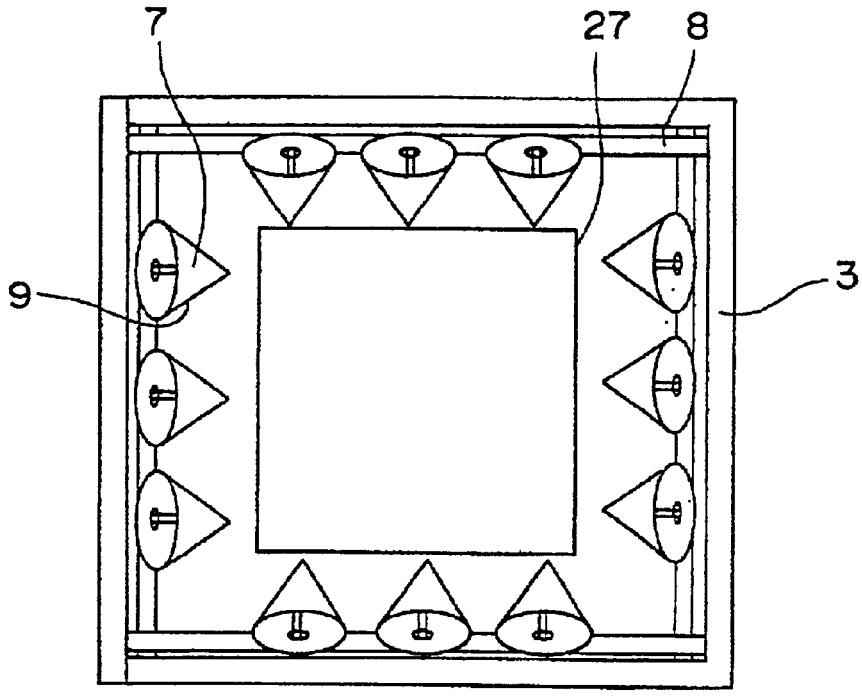
FIG. 7 is an explanatory view showing an arrangement of getter supports in Embodiment 2 of the present invention.

In Embodiment 1, a single getter support 7 is provided in the vacuum envelope 18. Two or more of the getter supports 7 may be provided in the vacuum envelope 18. FIG. 7 is an explanatory view illustrating an arrangement of the plural getter supports 7. When groups of the getter supports 7 are provided in the vacuum envelope 18, each group may be held by a corresponding support leg 8 to minimize the number of components as shown in FIG. 7. Also, as two opposite groups of the getter supports 7 are located on both sides of and sandwich the display area 27, the vacuum state in the vacuum envelope 18 can favorably be maintained uniform. Moreover, as the getter supports 7 are located outside of the display area 27 in the vacuum envelope 18, they can never disturb the display area 27 thus ensuring the uniformity of the vacuum state in the vacuum envelope 18.

According to this embodiment of the present invention, the getter 4 is provided in the vacuum envelope 18 prior to the step of completing the vacuum envelope 18 and can employ a evaporation type of the getter material which is higher in the getter effect than a non-evaporation type, e.g. N301 (made by Toshiba).

The spacer 3 is a rectangular frame of which the dimensions correspond to the size of the electron emitter substrate 25 and the light emitter substrate 26. More particularly, the spacer 3 is provided at both, upper and lower, sides with a uniform thickness, substantially 2 mm, of fritted glass.

When the electron emitter substrate 25, the light emitter substrate 26, and the spacer 3 have been assembled together in high accuracy and heated to a predetermined temperature under the vacuum state, the vacuum envelope 18 or the display device is fabricated (See FIG. 1).

A method of fabricating the getter support will now be described referring to FIGS. 8A to 8C.

Figure 8A:
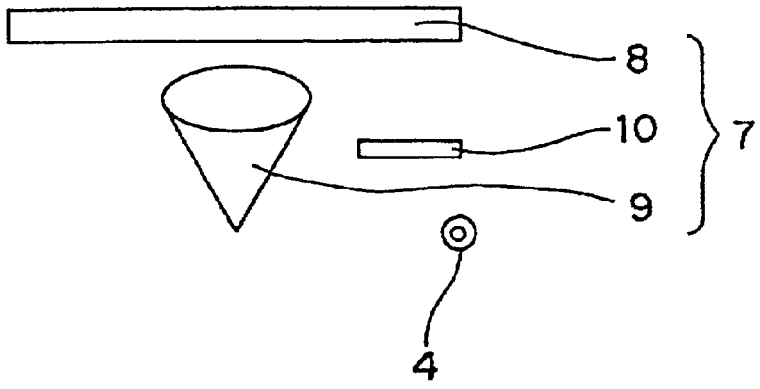
FIGS. 8A, 8B, and 8C are views showing a procedure of fabricating the getter support.
Figure 8B:
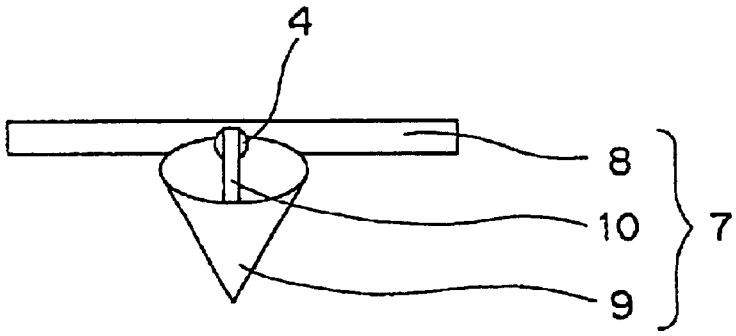
Figure 8C:
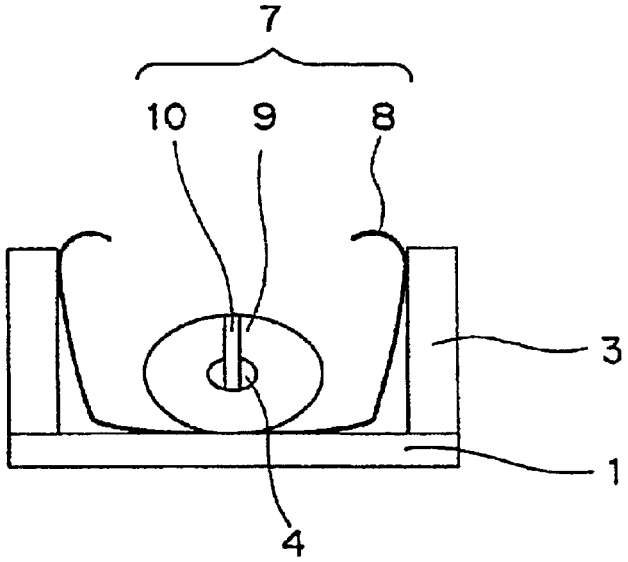

FIGS. 8A, 8B, and 8C illustrate a pre-assembled form, an assembling form, and an assembled form of the getter support 7, respectively. In this case, a stainless steel material of 0.07 mm thick is used. The getter support 7 comprises a getter 4, support leg 8, control plate member 9, and holder 10. As shown in FIG. 8B, the holder 10 is joined by welding to the back side of the getter 4 where the getter material 6 is not exposed. Then, the holder 10 and the control plate member 9 are joined to each other by welding and the control plate member 9 and the support leg 8 are joined to each other by welding. This is followed by bending the holder 10 so that the side of the getter 4 where the getter material 6 is exposed is located at the opening of the control plate member 9 and then folding the support leg 8 so that the getter support 7 sits in the vacuum envelope 18 as shown in FIG. 8C. As two distal ends of the support leg 8 are folded inwardly as shown in FIG. 8C, they remain not injuring any of the first glass substrate 1, the second glass substrate 2, and the spacer 3.

Preferably, as shown in FIG. 3A, the getter support 7 is anchored so that the opening of the control plate member 9 comes opposite to the wiring layer 12 and the electron emitter elements 13.

Another method of fabricating the getter support will be explained referring to FIGS. 9A to 9C.

Figure 9A:
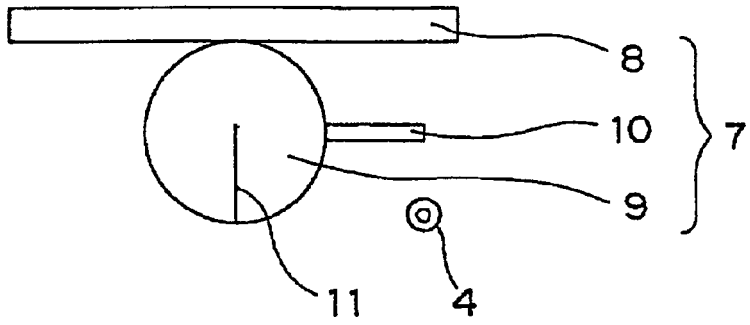
FIGS. 9A, 9B, and 9C are views showing another procedure of fabricating the getter support.
Figure 9B:
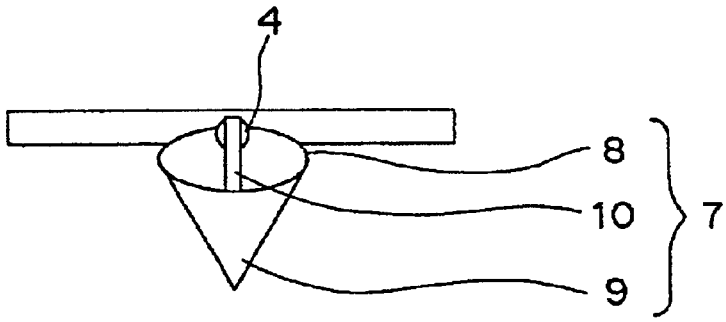
Figure 9C:
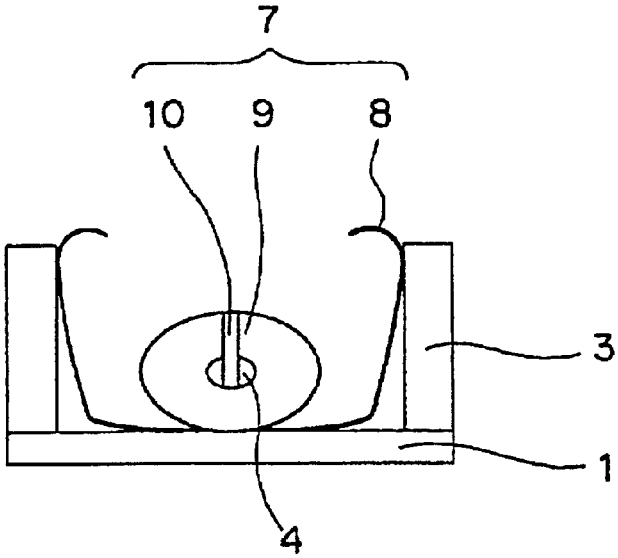

FIGS. 9A, 9B, and 9C illustrate a pre-assembled form, an assembling form, and an assembled form of the getter support 7, respectively. In this case, a stainless steel material of 0.07 mm thick is used. The getter support 7 comprises a support leg 8, a controlling member 9, and a holder 10 assembled together as a single unit, as shown in FIG. 9A. The control plate member 9 has a slit 11 provided therein for forming a conical shape. As shown in FIG. 9B, the holder 10 is joined by welding to the back side of the getter 4 where the getter material 6 is not exposed. The both sides of the slit 11 of the control plate member 9 is overlapped and welded each other to form a conical shape. This is followed by bending the holder 10 so that the side of the getter 4 where the getter material 6 is exposed is located at the opening of the control plate member 9 and then folding the support leg 8 so that the getter support 7 sits in the vacuum envelope 18. As two distal ends of the support leg 8 are folded inwardly as shown in FIG. 9C, they remain not injuring any of the first glass substrate 1, the second glass substrate 2, and the spacer 3.

Preferably, as shown in FIG. 3A, the getter support 7 is anchored so that the opening of the controlling member 9 comes opposite to the wiring layer 12 and the electron emitter elements 13.

A further method of fabricating the getter support 7 will be explained referring to FIGS. 10A to 10C.

Figure 10A:
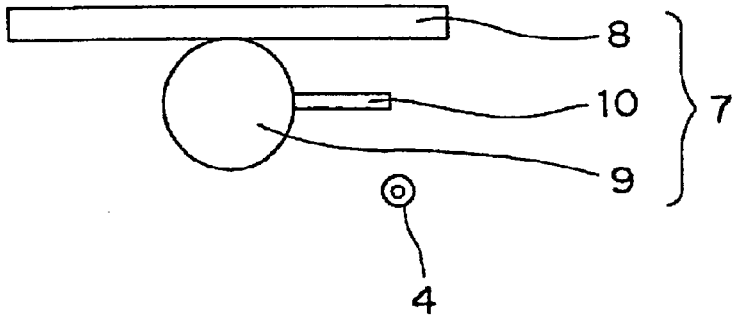
FIGS. 10A, 10B, and 10C are views showing a further procedure of fabricating the getter support.
Figure 10B:
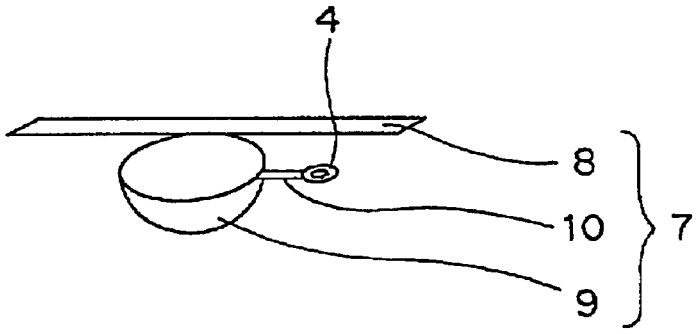
Figure 10C:
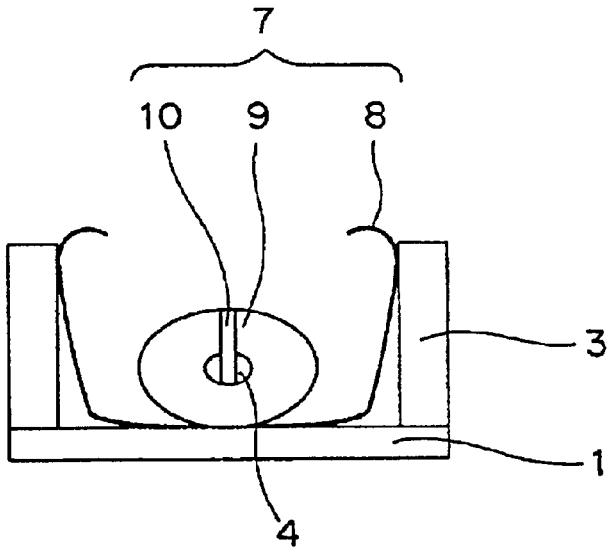
Figure 11:
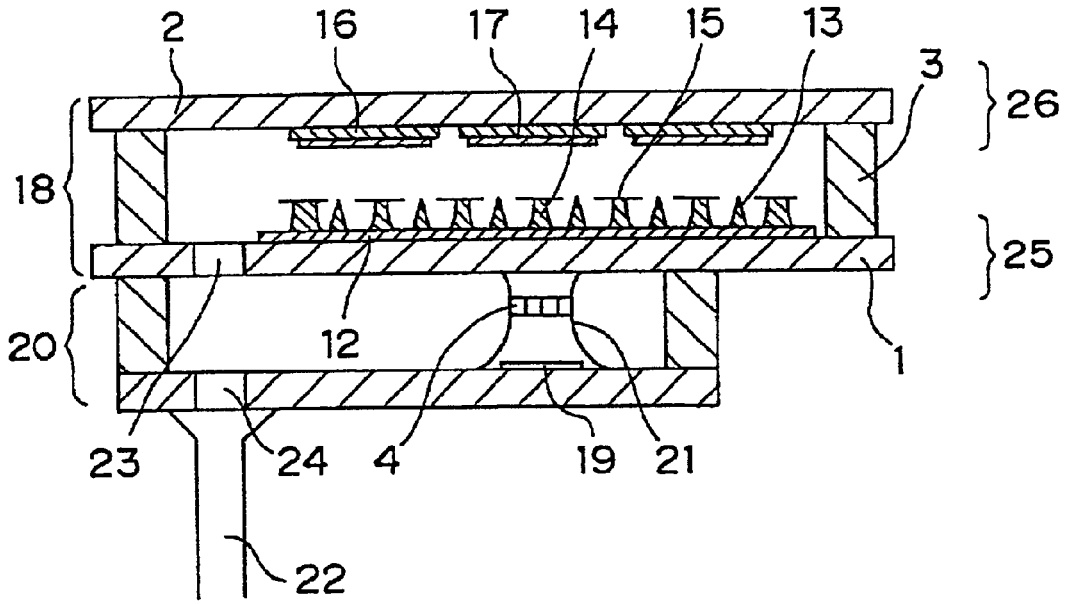
PRIOR ART Fig. 11
FIG. 11 is a cross sectional view of a conventional vacuum container.

FIGS. 10A, 10B, and 10C illustrate a pre-assembled form, an assembling form, and an assembled form of the getter support 7, respectively. In this case, a stainless steel material of 0.07 mm thick is used. The getter support 7 comprises a support leg 8, a control plate member 9, and a holder 10 assembled together in a single unit. The control plate member 9 is shaped to a desired 3-dimensional configuration by drawing. As shown in FIG. 10B, the holder 10 is joined by welding to the back side of the getter 4 where the getter material 6 is not exposed. This is followed by bending the holder 10 so that the side of the getter 4 where the getter material 6 is exposed is located at the opening of the control plate member 9 and then folding the support leg 8 so that the getter support 7 sits in the vacuum envelope 18 as shown in FIG. 10C. As two distal ends of the support leg 8 are folded inwardly as shown in FIG. 10C, they remain not injuring any of the first glass substrate 1, the second glass substrate 2, and the spacer 3.

Preferably as shown in FIG. 3A, the getter support 7 is anchored so that the opening of the control plate member 9 comes opposite to the wiring layer 12 and the electron emitter elements 13.

According to the materials, construction, and steps of the present invention, when the getter is disposed in the vacuum envelope 18, its supporting construction can be minimized in the number of components and its related method of fabricating a display device can be reduced in the number of steps. Therefore, the vacuum envelope 18 or the display device using the same will be improved in the degree of vacuum while the spreading of the getter material therein is controlled in desired directions. As the direction of the spreading of the getter material is controlled, the getter can favorably be disposed within the vacuum envelope 18 or the display device to be finished. Also, since a getter chamber required in the prior art is not needed, the vacuum envelope 18 or the display device can be made flat.

As set forth above, the vacuum container of the present invention has a getter provided therein while the number of components is minimized, the procedure of fabrication is simplified, the degree of vacuum is improved, and the spreading of getter flushes is controlled in directions. As the spreading of getter particles is controlled, the getter can be disposed within the vacuum container. Since a getter chamber required in the prior art is not needed, the vacuum container can be shaped flat.

Moreover, the display device of the present invention has a getter provided therein while the number of components is minimized, the procedure of fabrication is simplified, the degree of vacuum is improved, and the spreading of getter flushes is controlled in directions. As the spreading of getter particles is controlled, the getter can be disposed within the display device. Since a getter chamber required in the prior art is not needed, the display device can be shaped flat.

The present disclosure relates to subject matter contained in priority Japanese Patent Application No. 2000-228830, filed on Jul. 28, 2000, the contents of which is herein expressly incorporated by reference in its entirety.

What is claimed is:

1. A vacuum container having a getter with a getter material filled therein for maintaining a degree of vacuum, said vacuum container comprising:

a getter support including:

a control plate member, which defines a hollow space that has an opening, a closed end of the control plate member, being smaller than the opening; and a holder, wherein said holder is configured to support the getter material in a manner such that an initial spreading direction of the getter material during evaporation is away from a surface upon which the getter material is to be deposited, and said control plate member is arranged in the initial spreading direction of the getter material and configured to control spreading of the getter material in order to direct the getter material back toward the surface upon which the getter material is to be deposited.

2. The vacuum container according to claim 1, wherein the holder holds the getter with a spreading side of the getter located at an opening of the hollow space of the control plate member and the control plate member is fixedly anchored by a support leg provided in the vacuum container.

3. The vacuum container according to claim 2, wherein the control plate member is configured so that the getter material is reflected at least two times the control plate member.

4. The vacuum container according to claim 1, wherein when the control plate member comprises a combination of a conical shape and a cylindrical shape defining the hollow space, so that a longitudinal cross section thereof includes a vertex and a center of a base of the conical shape, an angle at the vertex of the control plate member is equal to or smaller than two times $\tan^{-1}$ (b/a) of the angle defined by a and b, where a represents a diameter of the cylindrical shape and b represents a height of the cylindrical shape, and the spreading side of the getter is positioned within an isosceles triangle with a base of a and angle at each end of the base is expressed by $\tan^{-1}$ (b/a).

5. The vacuum container according to claim 2, wherein the getter support comprises at least a metallic material.

6. The vacuum container according to claim 1, having a plurality of getter supports provided therein.

7. The vacuum container according to claim 1, further comprising a support leg that holds a plurality of control plate members.

8. A display device having a getter with a getter material contained therein for maintaining a degree of vacuum, said display device comprising:

a getter support including:

a control plate member, which defines a hollow space that has an opening a closed end of the control plate member, being smaller than the opening; and a holder, wherein said holder is configured to support the getter material in a manner such that an initial spreading direction of the getter material during evaporation is away from a surface upon which the getter material is to be deposited, and said control plate member is arranged in the initial spreading direction of the getter material and configured to control spreading of the getter material in order to direct the getter material back toward the surface upon which the getter material is to be deposited.

9. The display device according to claim 8, further comprising:

an electron emitter substrate having at least a wiring layer pattern, electron emitter elements, insulating layers, and lead electrodes on a first glass substrate;

a light emitter substrate having at least anodes and fluorescent layers on a second glass substrate; and a spacer provided between the electron emitter substrate and the light emitter substrate so that the electron emitter substrate and the light emitter substrate are spaced by a predetermined distance from each other.

10. The display device according to claim 8, wherein the holder holds the getter with a spreading side of the getter located at an opening of the hollow space of the control plate member and the control plate member is fixedly anchored by a support leg provided in the display device.

11. The display device according to claim 10, wherein the control plate member is configured so that the getter material is reflected at least two times by the control plate member.

12. The display device according to claim 8, wherein when the control plate member comprises a combination of a conical shape and a cylindrical shape defining the hollow space, so that a longitudinal cross section thereof includes a vertex and a center of a base of the conical shape, an angle at the vertex of the control plate member is equal to or smaller than two times $\tan^{-1}$ (b/a) of the angle defined by a and b, where a represents a diameter of the cylindrical shape and b represents a height of the cylindrical shape, and the spreading side of the getter is positioned within an isosceles triangle with a base of a and angle at each end of the base is expressed by $\tan^{-1}$ (b/a).

13. The display device according to claim 10, wherein the getter support is positioned between the electron emitter substrate and the light emitter substrate and the opening of the control plate member is at least not smaller than the size of the getter.

14. The display device according to claim 10, wherein the getter support comprises at least a metallic material.

15. The display device according to claim 8, having a plurality of getter supports provided therein.

16. The display device according to claim 8, further comprising a support leg that holds a plurality of control plate members.

17. The display device according to claim 8, wherein the getter support is located on an outer side of a display area of the display device.

18. The display device according to claim 8, wherein the getter supports are provided opposite to each other with respect to a display area of the display device.

19. The display device according to claim 9, wherein the side of the getter receiving the getter material faces the electron emitter elements and the getter support is provided between the getter and the electron emitter elements so that spreading particles of the getter material collide at least once with the the control plate member or are reflected at least once by the control plate member.

20. The vacuum container according to claim 1, wherein said control plate member has a conical pyramid shape.

21. The vacuum container according to claim 1, wherein said control plate member has a polygonal pyramid shape.

22. The display device according to claim 8, wherein said control plate member has a conical pyramid shape.

23. The display device container according to claim 8, wherein said control plate member has a polygonal pyramid shape.

* * * * *